United States Patent [19]

Bakker

[11] Patent Number: 4,492,345

[45] Date of Patent: Jan. 8, 1985

[54] PAPER ROLL REWINDER

[76] Inventor: William J. Bakker, P.O. Box 128, Caledon, Ontario, Canada, L0N 1C0

[21] Appl. No.: 405,769

[22] Filed: Aug. 6, 1982

[30] Foreign Application Priority Data

Aug. 7, 1981 [CA] Canada ..... 383453

[51] Int. Cl.[3] ..... B41J 15/16; B65H 17/02

[52] U.S. Cl. ..... 242/67.3 R; 242/68.4; 235/58 CF; 400/614

[58] Field of Search ..... 242/67.3 R, 67.1 R, 242/68.4, 67.1 D; 400/613, 614, 617; 235/58 CF

[56] References Cited

U.S. PATENT DOCUMENTS

| | | | |
|---|---|---|---|
| 1,702,971 | 2/1929 | Jeffress | 242/68.4 |
| 1,829,727 | 11/1931 | Barrett | 242/67.3 R X |
| 4,168,038 | 9/1979 | Nims | 242/67.3 R X |

OTHER PUBLICATIONS

Typewriter Ribbon Feed, IBM Technical Disclosure Bulletin, vol. 6, No. 4, Sep. 1963.

*Primary Examiner*—Stuart S. Levy
*Assistant Examiner*—Lloyd D. Doigan
*Attorney, Agent, or Firm*—Sim & McBurney

[57] ABSTRACT

There is provided an apparatus for allowing a paper tape to be unwound from a first roll by a printing unit, and for simultaneously rewinding the paper tape on a second roll. Each roll includes a hollow cylindrical core. The apparatus includes a low friction cylindrical axle means for positioning within the hollow core of the second roll, and alignment means for maintaining the axle means such that its axis remains parallel with the axis of the second roll, and for keeping the two rolls laterally aligned. Retention means are also provided for keeping the two rolls together, the retention means preferably including an elastic cord member adapted to pass in a closed loop through the hollow core of the first roll and through a central opening in the axle means positioned in the hollow core of the second roll.

3 Claims, 5 Drawing Figures

PAPER ROLL REWINDER

FIELD OF THE INVENTION

The present invention relates to a paper rolling system for feeding paper to a printing unit and for rewinding it so that it can be fed again into the printing unit, in order that the latter can print the unused side of the paper tape.

BACKGROUND OF THE INVENTION

It is well known that printing units such as adding machines operate with the use of paper tape that is fed through the unit, the paper tape being unwound from a roll of the paper tape with the help of automatic mechanisms in the unit. In operation, the printing unit will print on one side of the paper tape, and then index the printed tape outwardly while drawing further tape from the source. It is common experience that the printed paper tape produced by the printing unit forms a long, uncontrolled and cumbersome strip which is generally ripped off and discarded by the operator.

There are three significant disadvantages to this prior art procedure in regard to the paper tape. In the first place, it is difficult and cumbersome to store the individually ripped-off pieces of paper tape in the event that the operator wishes to keep a good record of the material printed on the tape. Secondly, conventional systems such as the printing system described above make use of only one side of the paper tape, because the machine is adapted to print on only one side of the tape. Thirdly, the machine's paper roll holder usually consists of arms and an axle. In the event of this breaking, there is no simple, inexpensive method for rendering the machine operative again.

It would be of advantage to provide a system by which the tape could be printed on both sides, and the attainment of this advantage is one of the aims of the present invention.

GENERAL DESCRIPTION OF THIS INVENTION

Accordingly, this invention provides an apparatus for allowing a paper tape to be unwound from a first roll by a printing unit, and for simultaneously rewinding the paper tape on a second roll. Each roll includes a hollow cylindrical core. The apparatus includes a low-friction cylindrical axle means for positioning within the hollow core of the second roll, and also incorporates alignment means for maintaining the axle means such that its axis remains parallel with the axis of the second roll, and for keeping the two rolls laterally aligned. Finally, the apparatus includes retention means for keeping the two rolls together. The retention means including an elastic cord member which is adapted to pass in a closed loope through the hollow core of the first roll and through a central opening in the axle means positioned in the hollow core of the second roll.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
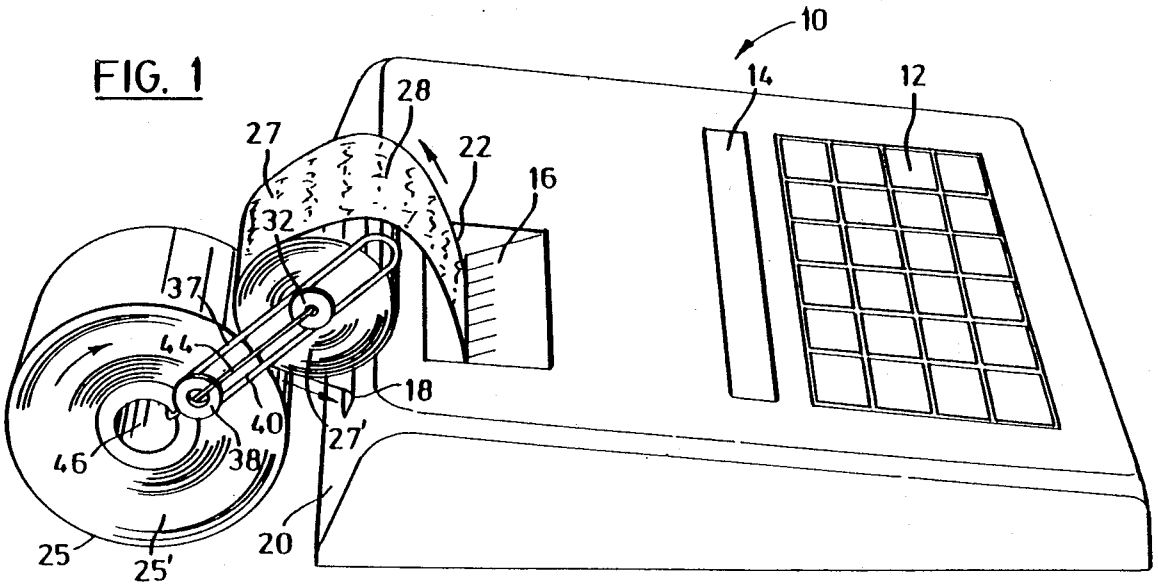
FIG. 1 is a perspective view of a typical printer calculator with which the apparatus of this invention can be used.

In FIG. 1, a printer-calculator 10 is illustrated, which includes a keyboard 12, an electronic display 14, and a window 16 under which the printing takes place. The printer-calculator 10 is one which is adapted to draw paper tape into itself through a slot 18 in its back wall 20, print numerals or other indicia on one side of the tape, and then feed the printed tape out of the unit at the rear edge 22 of the window 16. Under conventional practice, a roll of unused paper tape would be provided, fed through the printing unit, and then as the printer-calculator passed printed tape out along one edge of the window 16, the exiting tape would merely accumulate in a pile, possibly being torn off from time to time by the operator and discarded or filed.

In FIG. 1, a first roll 25 of paper tape is illustrated in juxtaposition against the back wall 20 of the printer-calculator 10.

In the arrangement shown in FIG. 1, a second roll 27, constituting a rewinding roll, is also provided. As can be seen, the second roll 27 is juxtaposed against the first roll 25, parallel with the same, and in lateral alignment. The term "lateral alignment", as used herein and in the appended claims, refers to a situation in which the rolls 25 and 27 are in alignment laterally of their axes. More specifically, when the two rolls 25 and 27 are in lateral alignment, the end face 25' of the roll 25 and the end face 27' of the roll 27 are coplanar. Since the two rolls 25 and 27 are the same length, the other ends would also be coplanar when the rolls are in lateral alignment. The roll 27 is located between the printer-calculator 10 and the roll 25, effectively resting in a "recess" provided between them. This would be the position of roll 25 if the machine were of the type where the paper roll holder is inside the machine housing, thus limiting access. The invention is constructed so that it will also function in conjunction with paper roll holders that hold the paper outside the machine housing, as in FIG. 1A.

As can be further seen in FIG. 1, the printed portion 28 of tape which is exiting from the printer-calculator 10 under the rear edge of the window 16 loops upwardly and then passes down between the two rolls 25 and 27, to be wound around the second roll 27. As the printer-calculator 10 draws tape from the first roll 25 into itself through the slot 18, the first roll 25 is caused to rotate in the clockwise direction as seen in FIG. 1. The second roll 27 is in frictional pressure contact with the first roll 25, through a mechanism shortly to be described, and thus the clockwise rotation of the first roll 25 will induce a counter-clockwise rotation of the second roll 27, as viewed in FIG. 1. The peripheral speeds of rotation of the two rolls will remain the same, and therefore the printed tape 28 will be wound up around the second roll 27 at substantially the same rate as tape is drawn off the first roll 25 through the slot 18 and into the printer-calculator 10.

It will also be understood, from looking at FIG. 1, that the tape 28 being ejected from the printer-calculator 10, having the printed side uppermost, will be wound around the second roll 27 with the printed side outwardly. When the entirety of the first roll 25 has passed through the printer-calculator 10 and has been wound upon the second roll 27, then replacement of the first roll 25 with the second roll 27 will allow the tape to be fed again into the slot 18, the unprinted side being presented to the printer under the window 16. Thus, both sides of the paper tape can be fully utilized by the machine.

Figure 1A:
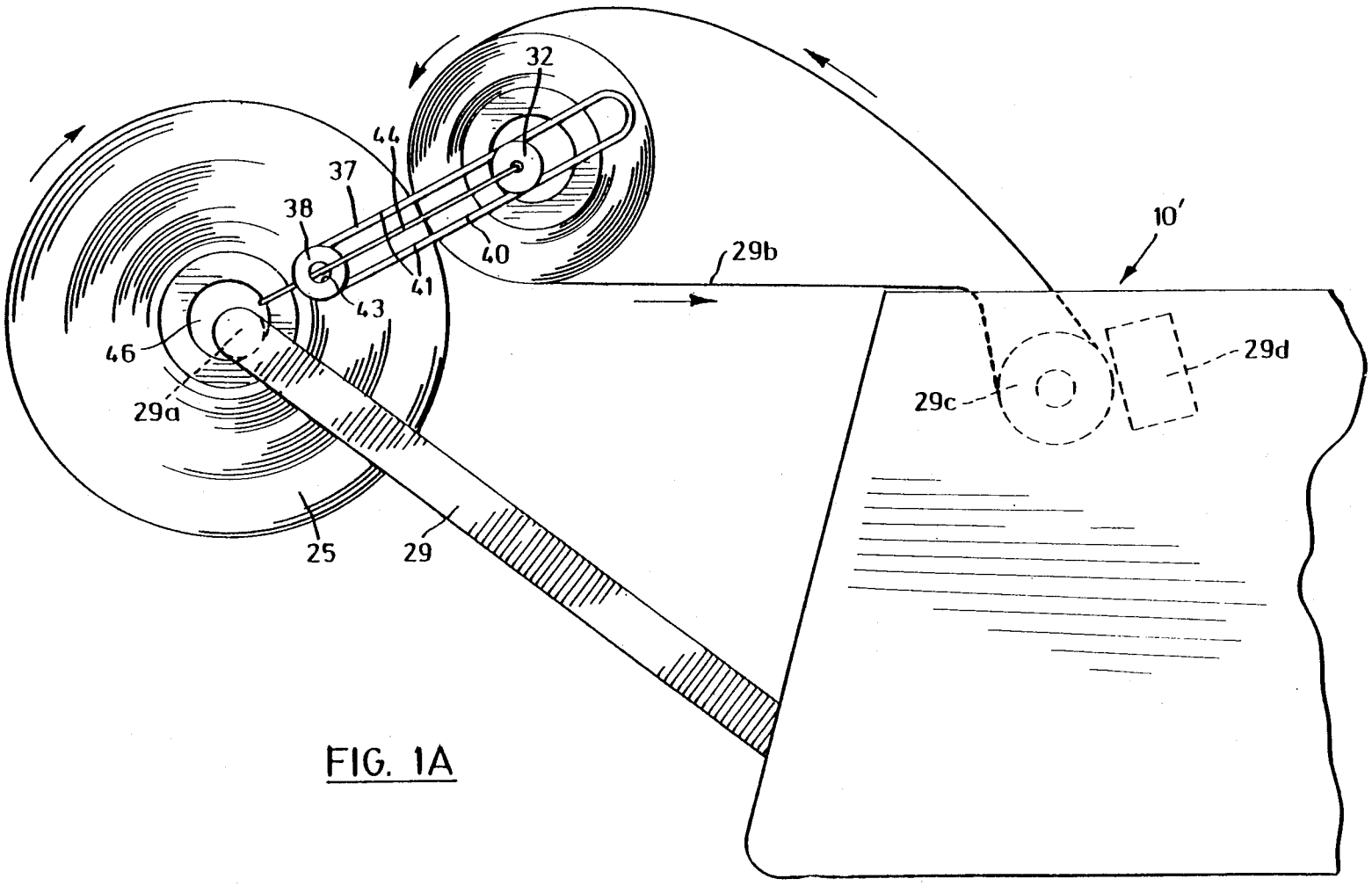
FIG. 1A is an elevational view of the rear end of another form of typical printer calculator, with which the apparatus of this invention can also be used.

Attention is now directed to FIG. 1A, which shows a variation for the construction of the rearward end of a printer-calculator 10'. As can be seen, a pair of roll holder arms 29 (only one visible in FIG. 1A) extend rearwardly and upwardly from the back of the printer-calculator 10', and support a shaft **29*a* adapted to extend through the centre of the roll 25. As in FIG. 1, the roll 27 is situated roughly between the roll 25 and the rearward portion of the printer-calculator 10', and slightly above. In effect, the roll 27 rests downwardly on the portion 29*b* of tape which is coming off the roll 25, and which is feeding into the top rear of the printer-calculator 10'. It will be noted that the printer-calculator 10' differs from that shown at 10 in FIG. 1, in that there is no entry slot 18 for the tape, but rather the tape enters the printer-calculator 10' at the top, very close to the position where the tape exits the printer-calculator 10'**.

Shown in broken lines in FIG. 1A is a standard printing roll **29*c*, and an adjacent printing device 29*d***, for example a thermal printer.

Attention is now directed to all figures simultaneously, for a description of the mechanism which retains the two rolls 25 and 27 in frictional contact, and keeps them laterally aligned. The mechanism to be described also promotes axial alignment between the two rolls 25 and 27, although this latter condition is promoted by the fact that both rolls 25 and 27 rest against the surface which supports the printer-calculator 10.

There is firstly provided a low-friction, cylindrical axle means adapted to be positioned within the hollow core 30 of the second roll 27. The arrangement is best seen in FIG. 2, from which it is evident that the low-friction axle means consists of two stub axles 32, each having a diameter allowing it to slip easily within the open core 30 of the second roll 27, and each having an axial bore 33, the bores 33 being aligned with each other in the condition shown in FIG. 2.

Figure 4:
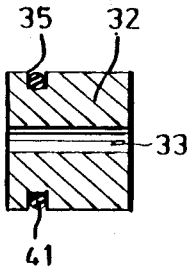
FIG. 4 is an axial sectional view taken at the line 4—4 in FIG. 3.

Furthermore, alignment means are provided for maintaining the stub axles 32 in positions such that they are coaxial, and such that they have their axes parallel with the axis of the second roll 27. The alignment means includes the provision of an annular gallery 35 (see FIGS. 3 and 4) around each stub axle. There are also provided two members 37 which are adapted to lodge in the respective galleries, and to extend perpendicularly to the axes of the stub axles in the direction of the first roll 25. Each member 37 is adapted to be juxtaposed against the respective end of both rolls, thus maintaining the rolls in lateral alignment, as defined earlier.

More specifically, each member 37 includes a washer portion 38 at one end, and a loop of wire 40 extending from the washer portion 38 to define two parallel straight wire portions 41, which are adapted to lodge in the gallery 35 of the respective stub axle 32. The washer portion 38 is offset from the ends of the straight wire portions 41, as best seen in FIG. 2. The washer portion 38 has a central aperture 43.

Figure 2:
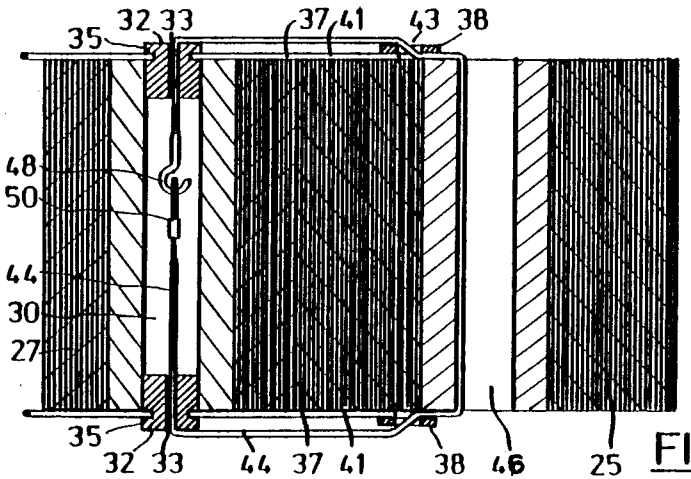
FIG. 2 is an axial sectional view taken through the axes of the two paper rolls of the apparatus of this invention.

As best seen in FIGS. 1 and 2, an elastic cord member 44 is provided, and this passes in a closed loop through the hollow core 46 of the first roll 25, through the central bores 33 in the stub axles 32, and thence through the hollow centre core 30 of the second roll 27.

To permit attachment and detachment of the apparatus with respect to the rolls 25 and 27, the elastic cord member 41 may be in the form of a single length of elastic material, having at one end a hook 48 and at the other end an eyelet 50, these latter being such that they may be connected together or disconnected as desired.

Figure 3:
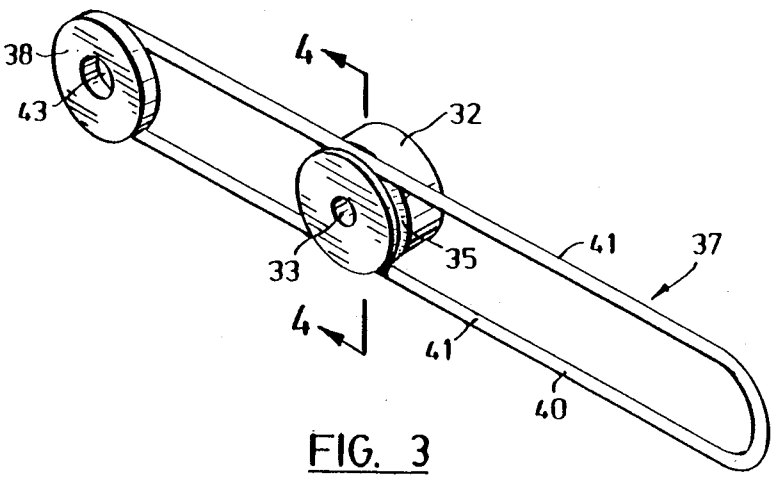
FIG. 3 is a perspective view of one component of the apparatus of this invention.

The particular construction shown in FIG. 3 is of advantage because it allows the apparatus to be adapted to any size of rolls, within reason. It will be realized that the member 37 will be able to slide through the gallery 35 of the stub axle 32, thereby to allow adjustment of the distance between the stub axle 32 and the washer portion 38.

In operation, it is important to adjust the position of the member 37 so that it spans across the junction between the two rolls 25 and 27. As can be seen in FIG. 2, the elastic cord member is fed through the aperture 43 in each of the washer portions 38, the elastic cord member passing from the core of the first roll 25 to the inside of the washer portion 38, thence outwardly through the aperture 43 to the outside of the washer portion 38, thence along and parallel to the member 37 to the point of entrance into the bore 33 of the corresponding stub axle 32. This construction allows the elastic to function in such a way that it urges the member 37 to remain lightly in juxtaposed contact with the end faces of both rolls 25 and 27, thus promoting lateral alignment without producing excessive friction which might interfere with the rotation of the second roll 27. To disconnect the elastic core member, the stub axle 32 is withdrawn out of its connection with the leftward core in FIG. 2, and this simply pulls the portions 48 and 50 out into the open where they can be disengaged. The reverse process is used to connect them together.

It will be readily understood from the above description that the paper rolling system herein disclosed not only provides for rewinding of used paper tape for storage purposes, but also provides a reversal of the paper so that the second roll 27 may be substituted for the first roll 25 after the paper on the first roll 25 has been exhausted, thus permitting the tape to go through the printer-calculator on a second pass with its unprinted side exposed to the printing unit. Thus, the usage of the paper is doubled, and wastage is halved.

While a particular embodiment of this invention has been described and illustrated in this disclosure and the accompanying drawings, it will be evident that variations may be made thereto, without departing from the spirit and scope of the invention as defined herein and as set forth in the accompanying claims.

I claim:

1. Apparatus for allowing a paper tape to be unwound from a first roll by a printing unit, and for simultaneously rewinding the paper tape on a second roll, each roll including a hollow cylindrical core, the apparatus comprising:

low-friction cylindrical axle means for positioning within the hollow core of the second roll, alignment means for maintaining said axle means such that the axis of the axle means remains parallel with the axis of the second roll, and for keeping the two rolls laterally aligned, and retention means for keeping the two rolls together, said retention means including an elastic cord member adapted to pass in a closed loop through the hollow core of the first roll, between the two rolls, and through a central opening in the axle means positioned in the hollow core of the second roll, the axle means including two stub axles, each adapted to enter one end of the hollow core of the second roll, and each having an axial bore through which the elastic cord member passes, the alignment means including an annular gallery around each stub axle, and for each stub axle a member adapted to lodge in the gallery and to extend perpendicular to the axis of the stub axle, the member being juxtaposed and urged against the respective end of both rolls by the elastic cord member, thus maintaining the rolls laterally aligned, the two members being separate and independent of one another, and linked only by the elastic cord member.

2. The apparatus claimed in claim 1, in which the member includes a washer portion at one end, and a loop of wire extending from said washer portion to define two parallel straight wire portions which are adapted to lodge in the gallery of a stub axle, the washer portion being offset from the ends of the straight wire portions.

3. The apparatus claimed in claim 2, in which the elastic cord member includes a releasable connection for attaching the cord member through the rolls and for detaching it therefrom.

* * * * *